United States Patent [19]

Lochner

[11] 4,047,269

[45] Sept. 13, 1977

[54] METHOD AND APPARATUS FOR PRODUCING ORNAMENTALLY PATTERNED, NEEDLED, NONWOVEN PILE FABRICS

[75] Inventor: Herbert Lochner, Kempen, Germany

[73] Assignee: cikalon-Vliesstoff-werke GmbH, Kempen, Germany

[21] Appl. No.: 699,599

[22] Filed: June 24, 1976

Related U.S. Application Data

[63] Continuation-in-part of Ser. No. 455,897, March 28, 1974, abandoned.

[30] Foreign Application Priority Data

Apr. 7, 1973 Germany ..... 2317637

[51] Int. Cl.[2] ..... D04H 18/00; D04H 11/00

[52] U.S. Cl. ..... 28/109; 28/111

[58] Field of Search ..... 28/4 R, 4 N, 72.2 R, 28/109, 111; 19/155, 156, 156.3; 26/2 R, 15 R, 27

[56] References Cited

U.S. PATENT DOCUMENTS

| | | | |
|---|---|---|---|
| 1,749,829 | 3/1930 | Mason | 26/15 R |
| 1,889,902 | 12/1932 | Moore | 26/2 R |
| 1,895,843 | 1/1933 | Boyd | 26/15 R X |
| 1,915,106 | 6/1933 | Shuttleworth | 26/2 R |
| 2,132,530 | 10/1938 | Greiser | 28/72.2 R X |
| 2,314,162 | 3/1943 | Reinhardt | 28/72.2 R X |
| 2,635,301 | 4/1953 | Schubert et al. | 19/156 |
| 2,743,758 | 5/1956 | Uschmann | 19/156 X |
| 2,919,475 | 1/1960 | Heppenstall et al. | 19/155 |
| 3,071,822 | 1/1963 | Meiler | 19/156.3 |
| 3,613,190 | 10/1971 | Crosby | 28/72.2 R X |
| 3,705,064 | 12/1922 | Lochner | 28/72.2 R X |
| 3,856,602 | 12/1974 | Colijn et al. | 28/72.2 R X |

FOREIGN PATENT DOCUMENTS

| | | | |
|---|---|---|---|
| 1,040,598 | 9/1966 | United Kingdom | 28/72.2 R |

OTHER PUBLICATIONS

Burns, G. F. *Spooner Develops Equipment and Technology for Needled Velours Floorcoverings,* Textile Month, p. 69–71, Feb. 1973.

Knaus et al., *Putting Patterns into Needle Felts,* Textile Manufacturer, 99(1169), pp. 48–51, July 1972.

*Needle Punched Carpets with Pile and Texture,* Textile Manufacturer, 98(1161), pp. 50, 51, Oct. 1971.

*Primary Examiner*—Robert R. Mackey

*Attorney, Agent, or Firm*—Toren, McGeady and Stanger

[57] ABSTRACT

Pile fabric is produced by needling in an ornamental pattern a pile layer of loose fibers through the back or nonvisible side of a fabric backing web which is intermittently passed with its back side up through a series of needling stations comprising needles disposed in a particular arrangement to form the fibers into the backing web in a predetermined pattern. A feed duct including a discharge port extending across the fabric web transversely of its feed direction is arranged to deliver fibers onto the back side of the web at a point upstream from the needling station. A suction duct located downstream from the needling station draws loose fibers from the back side of the web through an inlet port which extends across the web transversely of the feed direction. A driven roller located at the discharge port of the feed duct operates to distribute across the web the fibers being delivered thereon and a brush or shearing roller may be arranged downstream of the needling station near the inlet port of the suction duct to draw off loose fibers which have not been suitably needled into the backing web. A pile layer in a predetermined ornamental pattern which is visible from the front or lower side of the web may be formed by sequentially intermittently passing the web through a plurality of needling stations each of which comprises needles disposed to form a section of the overall pattern desired.

10 Claims, 2 Drawing Figures

METHOD AND APPARATUS FOR PRODUCING ORNAMENTALLY PATTERNED, NEEDLED, NONWOVEN PILE FABRICS

This application is a continuation-in-part application of my prior application Ser. No. 455,897 filed Mar. 28, 1974, now abandoned.

BACKGROUND OF THE INVENTION

The present invention relates generally to machinery for the production of ornamentally patterned pile fabrics, and particularly to the formation of nonwoven pile fabrics which are produced by needling pile fibers into a supporting web with the fibers arranged thereon in a particular pattern corresponding to the ornamental arrangement desired. The invention also concerns a particular method for producing such pile fabric and a needling machine for performing the method.

Prior art methods for the production of needled, ornamentally patterned, nonwoven pile fabrics are known, for example, from U.S. Pat. No. 3,705,064, wherein at least two nonwoven fabric webs strengthened by a needling operation are used to form the finished fabric. Patterning is achieved by joining together fabric webs which are solid colored or which comprise mixed colors with one of the webs being printed on one side with pigment dyes to form an ornamental pattern. The printed side of one nonwoven fabric web is arranged to face away from the unprinted side of the other nonwoven fabric web, and the webs are subsequently subjected to a needling operation from the unprinted surface so that the fibers of the unprinted web blend with the fibers of the printed web to thereby form a nap upon the printed area. In this manner, a printed ornamental pattern is produced with a soft, patterned 3-dimensional effect.

In another prior art method known from German Pat. No. 1,960,753, a patterned nonwoven needled fabric is produced by application of a glue upon side of a solid colored needled fabric web with the desired ornamental pattern penetrating into the web. After it is dried, this web is placed with the side remote from the glued side against a second differently colored needled web having mixed or contrasting colors, with both the webs being jointly needled from the glued side. In this method, the ornamental pattern is obtained by needling fibers on the unglued side of the glued web through the web to be patterned so that a pattern is formed on the visible surface appearing thereon as a finished nap. However, in the range of the glued areas, the web which is ornamentally patterned with the glue is only partially needled with the web which is to be patterned.

In still another known method according to German Pat. No. 1,960,363, production of a patterned and needled nonwoven fabric is accomplished by utilizing two solid colored or mixed colored nonwoven fabric webs which are strengthened by needling with one of the webs being printed with a differently colored pattern and with the webs being placed one upon another and needled through from the printed web side so that the fibers colored by the printing penetrate to the outer surface of the unprinted web thereby forming a visible pattern on the nonwoven fabric. A product produced by this method has upon the originally unprinted visible side the pattern of the printed rear web, with the entire visible surface having a naplike appearance due to the needling process which is effected over the entire area.

Both the unprinted fibers and those which are colored by the printing process appear on the visible side and thereby produce upon the visible surface the ornamental pattern which is printed on the back of the web.

It has also been known in the prior art to print a desired ornamental pattern directly upon the visible side of a web. This, however, involves a considerable disadvantage inasmuch as when such a nonwoven fabric is used as a floor covering, the ornamental pattern will be worn off within a relatively short time due to the fact that the pattern lacks the depth which is achieved by some of the previously mentioned prior art methods. Furthermore, because the fabric is printed directly upon the visible side it loses its nappy appearance due to the printing process.

Most known methods for the production of ornamentally-patterned nonwoven fabrics involve disadvantages by virtue of the fact that several operations are required for the production of the ornamental pattern. Printing of the pattern on one side or the other of one or more of the webs which are utilized is necessary and the webs must be subsequently needled and, as in one of the known methods, glue must be applied in the form of the ornamental pattern to be achieved. Apart from the time consuming operations which are required to form the ornamental pattern by application of printing ink or glue, such known methods involve further disadvantages since considerable amounts of glue and ink must be used.

In view of the foregoing, attempts have been made in accordance with German Pat. No. 1,977,417 to produce an ornamental pattern by utilizing needles which are arranged in the form of the pattern to be effected with two differently dyed nonwoven fabric webs being placed one upon the other and then needled through only within the range of the area where the ornamental pattern is to be achieved. In this approach, the fibers of the second web which are of a different color become visible in accordance with the arrangement of the needles upon the visible side of the web. However, a disadvantage arises in this situation inasmuch as the two webs are only needled in the range or area where the ornamental pattern is desired and no needling is effected in areas or regions which are to be free of the ornamental design. A further disadvantage resides in the fact that only solid colored ornamental patterns can be produced thereby rendering patterns having multicolored configurations unattainable.

In view of the foregoing, the present invention, which proceeds from the last-mentioned method for the production of ornamentally patterned nonwoven fabrics involving needling of fibers into a supporting web only in the area corresponding to the ornamental pattern to be achieved, is intended as an improvement over such methods whereby there may be developed an approach which permits achievement of multicolored patterns and which allows the entire surface area of a nonwoven fabric to be needled during the production process.

SUMMARY OF THE INVENTION

In accordance with the present invention, the production of ornamentally patterned nonwoven fabrics is performed by applying loose, staple fibrous material of a particular color upon a solid-colored or mixed-colored nonwoven or woven supporting fabric web which is strengthened by needling and/or by binders. The supporting fabric forms a backing web and the loose staple fibrous material is needled into this supporting web from the backside of the web within the range or area where the ornamental pattern is to be provided. During the needling process, the supporting web is maintained stationary and immediately after the needling process has been performed, fibers which have not been adhered to the backing web by the needling operation are drawn off by a suction or vacuum. The supporting web is intermittently fed through the needling apparatus backside-up with the needling of the fibers into the web being performed each time the web is stopped. During this operation, the entire surface of the supporting web may be covered with fibers and, if necessary, an additional prestrengthened nonwoven fabric layer may be applied over the entire surface of the supporting web.

The apparatus of the present invention comprises a plurality of needling stations at which there are located needles which are disposed in a particular arrangement to impart a predetermined pattern to fibers which are to be needled into the supporting web. Each of the needle stations may have the needles located thereat arranged in such a manner that each station produces only a designated portion of the ornamental pattern which is to be applied. A feed duct arranged adjacent each needling station on the upstream side thereof delivers fibers onto the intermittently moving web through a discharge port located to extend across the web transversely of its feed direction. A driven roller is located in the vicinity of the discharge port and operates to distribute the delivered fibers upon the web. A suction duct is located downstream of each needling station and as the web passes beyond the needles, loose fibers which have not been properly adhered to the web are drawn off from the backside of the web through an inlet port of the suction duct extending across the web transversely of the feed direction.

In accordance with the invention, a supporting web of the type previously described is thus moved intermittently through the apparatus with its backside facing upwardly and loose staple fiber material of a desired color is applied upon the web and is mechanically joined to the web by needling within the region or area of the ornamentation which is to be produced. Needling is selectively effected at those points where a corresponding color for the desired pattern is to be applied. As a result of the needling operation, the front side of the web which is intended as the visible side of the fabric when it is in use and which is downwardly-facing during the needling operation, has produced thereupon the desired ornamental pattern.

During the patterning process, the intermittently-advancing web is maintained stationary while fibers of a particular color are applied and is subsequently moved an appropriate distance to a succeeding station after the patterning of a certain color is completed.

After loose staple fibrous material of a certain color has been applied to form a particular part of the ornamental pattern, those fibers which have not been joined with the supporting web by the needling operation are drawn off by suction or vacuum immediately downstream of each needling station. It is considered preferably to arrange the needles of the apparatus closely together in order that there may be obtained a precise and adequate connection of the fibers upon the supporting material. A limited number of strokes of the needles is thus sufficient to obtain adequate connection of the fibers with the supporting material. However, the strengthening which thus occurs is not sufficient for proper formation of mechanically strengthened nonwoven fabric since the mechanical fastening which occurs is effected with unavoidable intervals between the individual needles. It has been found, for example, that intervals of 3 mm will occur between individual needles. In view of this, removal of the unneedled staple fibers by suction may be followed under a uniform feed of the supporting web by a process of needling up, down or through the web over its entire surface so that, if necessary, an additional prestrengthened nonwoven fabric may be applied to the supporting web.

If, for example, the staple fibers are needled through following the patterning, it may be of particular advantage to apply an additional prestrengthened nonwoven fabric in order to achieve a backing which is smooth and which imparts an aestehtic appearance to the fabric. This may be accomplished even before the continuous pile needling but after the intermittent patterning is completed. The mechanically prestrengthened nonwoven fabric cover may have a neutral color so that the finished pile rows which are formed appear on the front side of the web as a color mixture of the fibers of the additional cover fabric, on the one hand, and of the patterning color of the applied fibers, on the other hand. The color intensity of the color mixture in the pile rows depends particularly upon the selection of the needles, the depth of puncture, the thickness of the supporting material used and hence of the supporting web and, in the given case, upon the cover web used on the one hand, taken relative to the amount of fibers used for the pattern, on the other hand.

In accordance with another feature of the invention, the needling of additional ornamental regions into the supporting web by utilizing loose staple fiber material of a different color to achieve an additional ornamental section or pattern, and the drawing off by suction of the unneedling staple fiber material, may be repeated a number of times corresponding to the number of colors which are to be used in forming the ornamental pattern. The patterning process may thus be repeated as necessary until the fibrous material is mechanically connected with the supporting web in the various colors which are to appear in the ornamental pattern. This is accomplished until the pattern is thus completed.

It is of course possible to use a single color for the pattern or several colors may be used. Also, the supporting material may be partially covered with the applied fibers or it may be covered therewith over its entire surface area. If, for example, four colors are to be used, four needling units will be required to perform the entire patterning operation. In such a case, the repeat distance may be identical with the respective width of an individual needle board. If the repeat is to be greater, that is if its dimensions are to exceed the width of a needle board, it is possible to utilize two or more patterning units for a particular color and in this way obtain the desired repeat. For example, with four colors and three needling units per color, a total of twelve needling units may be arranged in series. The size of the repeat may thus be determined within wide limits. There will also be a wide available range with regard to the number of colors which may be utilized.

During the patterning operation described above, it is important that the fibers which form the desired pattern are adequately connected with the supporting material at the proper point determined by the pattern of the ornament in order to be able to remove those fibers which are not connected with the supporting material.

After the patterning has been completed in the manner described above, the staple fibers are drawn up, down, or in the case of a nonwoven pile fabric, through in a known manner in a continuous feed.

In a further development of the method according to the present invention, a brushing or shearing operation may be arranged to immediately follow the needling operation whereby removal by suction of loose staple fiber material which has not been properly connected with the supporting web may be facilitated.

It is of particular advantage that the needling which is performed is effected from the backside of the web since this not only facilitates the removal of loose fiber but it also renders unnecessary utilization of a latex coating or layer upon the backside of the fabric. As a result, the combination of needling from the backside and utilization of suction, with or without a brushing or shearing operation, enables formation of the desired ornamental pattern with better accuracy.

The invention is further concerned with a needling machine for carrying out the method according to the invention wherein at least one needle board is associated with the intermittently moving prestrengthened supporting material and which can be moved back and forth for the needling process perpendicularly to the plane of the supporting web.

In the operation of the apparatus of the present invention, the loose staple fiber material is first applied upon the backside of the supporting web at a point prior to passage of the web by the needle board which comprises the particular needle arrangement corresponding to the ornament shape which is desired for the applied fiber. The particular fiber color is thus needled into the supporting web in the shape desired for the particular color involved with the unneedled fiber being subsequently removed after the web has passed from the area of the needle board. In order to facilitate removal of the loose fiber material after needling, a driven brushing or shearing roll may be arranged downstream of the needle board but upstream of the suction duct.

If needling machines or needling units of the aforementioned type are arranged in series, and if a supporting web is moved through each station comprising a needling unit, each machine will produce a particular ornamental pattern. The arrangement of the needles and of the needle board may be such that the differently colored ornaments may adjoin each other directly and complement each other to yield total ornaments of different patterns and colors.

If the required needle arrangement for each needling board is maintained together with the indicated arrangements for the feed duct, the distributor roller, the suction duct and the brushing or shearing roller, conventional needling machines of various types may be utilized together with principal elements of the present invention. Such prior art machines may thus be supplemented with the features of a machine according to the present invention thereby permitting utilization of the method of the invention.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE INVENTION

Figure 1:
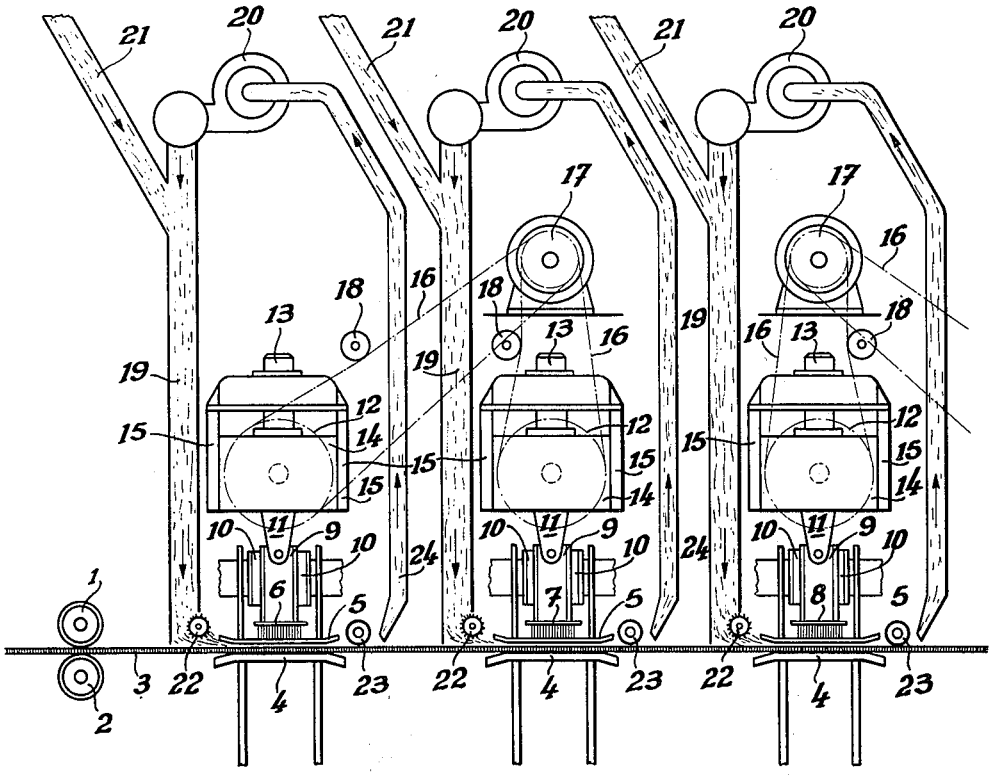
FIG. 1 is a side elevation showing a schematic representation of a machine arranged with a plurality of individual needling units in accordance with the present invention.

In FIG. 1, a needling machine is schematically represented which includes three needling units but which may be arranged to include additional needling units (not shown) following the three units which are depicted.

In the arrangement depicted, the driving motor of one needling unit serves to simultaneously drive an adjacent needling unit. A pair of input rolls 1 and 2 operate to introduce into the apparatus a supporting web which is strengthened by needling. Corresponding exit rollers (not shown) may be arranged at the opposite or right hand end of the machine, in order to appropriately receive the finished web, for example, by winding the web upon a drum.

The supporting web which is introduced through the feed rolls 1 and 2 is moved through the apparatus in an intermittent fashion and is supported in the range of each of the needling units or stations by support plates 4 which are provided with holes or oblong slots for passage there through of needles. Located above the supporting plates 4 and arranged at a distance corresponding to the thickness of the moving fabric there are provided vertically adjustable retaining plates 5 which are configured with holes to permit passage therethrough of needles which extend from needle boards 6, 7 and 8. The needle boards 6, 7 and 8 are each located, respectively, at one of the three needling stations depicted in FIG. 1 and they are secured within slides 9 to be vertically movable upwardly or downwardly relative to each of the needling stations. Guides 10 located in the machine frame operate to direct the vertical movement of the needle boards 6, 7 and 8 and eccentric cranks 11 are articulated at their upper ends and are provided to drive the needle boards 6, 7 and 8 through their vertical movement upwardly or downwardly of each needling station. The eccentric cranks 11 are attached to eccentric disks 12 which are rotatably arranged to drive the slides 9, and thus the needle boards 6, 7 and 8, upwardly or downwardly.

The depth of puncture of the needles of each of the needle boards may be varied by adjusting gear (not shown) in a manner which permits displacement of bearing blocks 14 which are arranged to support the eccentric disks 12 within guides 15. The eccentric disks 12 are driven by belts 16 which are operatively associated in pairs with motors 17 to transmit driving power therefrom. Tension rollers 18 engaging the belt 16 insure the necessary belt tension when the vertical position of the bearing blocks 14 is changed. It will be noted that two driving motors 17 are shown and that each of the driving motors 17 is arranged to drive a pair of adjacent units through a pair of belts 16, with the driving motor 17 located at the rightmost end of the drawing being arranged to drive a needling unit which is not shown but which would be located to the right of the arrangement shown in FIG. 1.

Thus it will be seen that each of the needling boards 6,7 and 8 defines a needling station and that as the supporting web 3 is passed to the right, as viewed in FIG. 1, through the apparatus of the invention, a separate needling operation will occur at each of the needling stations defined by each of the needle boards 6, 7 and 8.

Directly adjacent each of the needling units there is provided a feed duct 19 located on the upstream side of each needling station. The feed duct 19 includes at its lowermost end a discharge port which extends across the entire width of the supporting web 3 in a direction transversely of the feed direction of the web 3. Loose staple fiber material preferably of a predetermined desired color, is fed through a duct 21 by means of a blower 20 into the feed duct 19 and through its discharge port from which it is delivered directly upon the upwardly facing surface of the supporting web 3. A driven distributor roller 22 is located in the mouth of the discharge port of the feed duct 19 and extends across the supporting web 3 transversely of its feed direction. The roller 22 is rotatively driven in order to distribute the loose staple fiber material with a certain layer thickness over the upper surface of the supporting web 3.

On the downstream side of the needling station and directly beyond the retaining plate 5, a brushing or shearing roller 23 is arranged to extend across the width of the supporting web 3 transversely of the feed direction thereof. A suction duct 24 is located downstream of the brushing roll 23 with an inlet port extending across the entire width of the supporting web 3 in a direction transversely of the feed direction of the web 3. The inlet port of the suction duct 24 is located above the web 3 adjacent thereto and loose staple fiber material which is not suitably attached to the web 3 by the needling operation is drawn off by suction from the upper surface through the duct 24 by means of the blower 20 which creates a vacuum enabling such loose staple fibers to be passed from the duct 24 to be recycled back into the feed duct 19 so that they may be once again redelivered upon the supporting web 3 for passage through the needling station.

Figure 2:
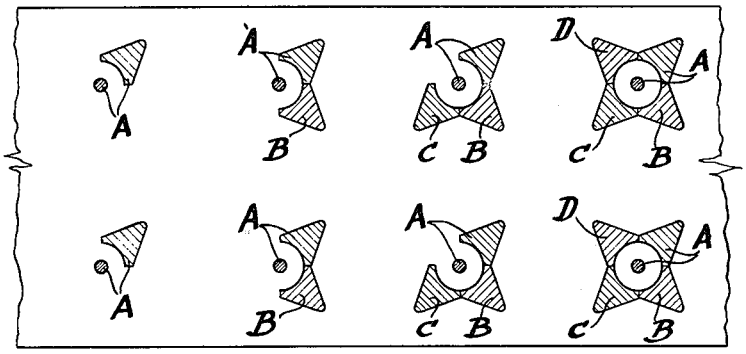
FIG. 2 is a schematic plan view showing a nonwoven fabric upon which there is produced a multicolored ornament during passage of the fabric through the needling machine of the invention.

Each of the needle boards 6, 7 and 8 are arranged with a set of needles adapted to produce a particular ornamental shape or configuration in the supporting web 3. For example, and referring more particularly to the supporting web shown in FIG. 2, it may be assumed that the needle board 6 is equipped with needles arranged in such a manner that an ornamental pattern corresponding to the pattern labeled A in FIG. 2 may be produced upon supporting web 3 when it is passed through the needling station defined by the needle board 6. In the operation of the device, the supporting web 3 is stopped so that a section of the web 3 at which the pattern A is to be produced is located and held beneath the needles of the needle board 6. With the web held stationary in this position, the operation of the needle board 6 is performed and the web is subsequently passed to the next succeeding needling station. As it leaves the needling station of the needle board 6, the web 3 will have thereupon a pattern or ornamental outline such as the pattern A.

Thus, for example, assuming that the supporting web 3 consists of fabric made of material which has not been dyed, and assuming that a red ornamental pattern is to be needled into it, red staple fibers would be applied upon the supporting web 3 through the first duct 19 located upstream of the needling board 6 with distribution of the red fibers being effected by the distributor roller 22. With the supporting web 3 being intermittently advanced, as previously described, the needling will be effected by the needles of the needle board 6 with the web 3 held stationary so that the loose red staple fibers located within the range of the needles of needle board 6 will be attached to the web 3 to produce the ornamental pattern A.

Subsequently, supporting web 3 is moved further downstream of the apparatus until the ornamental pattern A is within the range of the needles of needle board 7. As this section of the supporting web 3 passes from beneath the needle board 6, the roller 23 will loosen or raise staple fibers which have not been suitably attached to the supporting web 3 or, if the roller 23 is designed as a brush roll, it will brush up such excess fibers. As the web 3 passes beyond the roller 23, the loose fibers whose disengagement has been promoted by the roller 23 will be drawn off through the suction duct 24 adjoining the needle board 6. The supporting web 3 will thus be devoid of red colored staple fibers except for those which have been suitably adhered to the web 3 to form the ornamental pattern A by the needles of the needle board 6.

As the supporting web 3 moves downstream of the apparatus, the section thereof containing the ornament A will be stopped at an appropriate location beneath the needle board 7 so that the ornamental pattern A may be supplemented by the addition of a further ornamental section or pattern B which may, for example, be of a blue color. The needle board 7 will thus be equipped with needles arranged in a pattern which is designed to produce the ornamental pattern B adjoining the ornamental pattern A. Thus, an overall pattern which is the combination of A and B will be effected. The operation of the apparatus at the needling station defined by the needle board 7 is identical to that of the needling station defined by the needle board 6. Thus, blue staple fibers will be delivered through a feed duct 19 upstream of the needle board 7 and they will be distributed upon the web 3 by a distributor roller 22. Following the needling operation, whereby the ornamental pattern B is effected by the needle board 7, loose fibers will be alleviated by the roller or brush 23 and they will be withdrawn by suction through a duct 24 immediately downstream of the needle board 7.

It will be apparent that a similar process may be performed at each of a plurality of serially arranged needling stations along the length of the apparatus. For example, one additional needling station is shown in FIG. 1 which comprises a needle board 8 whose needles are arranged to produce the ornamental section labeled C in FIG. 2. With the ornamental sections A and B already applied, the needling station defined by the needle board 8 will supplement the ornamental pattern by the addition of the ornamental section C. This ornamental section may be of any desired color and it may, of course, comprise a color different than the colors of sections A and B. It will be apparent that after the production of section C, further ornamental sections, such as for example the ornamental section D, may be produced by additional downstream sections of the needling apparatus. Thus, an overall ornamental pattern comprising the sections A, B, C and D, as depcited in FIG. 2 may be produced. At each needling station, the fibers are delivered by a feed duct 19 and distributed by a distributor roller 22 and loose fibers are withdrawn through a suction duct 24 cooperating with a roller or brush 23. At each phase of the needling operation, the web 3 is stopped with appropriate sections located beneath the needle boards of each of the needling stations so that a desired pattern may be obtained.

The application of ornaments such as the pattern comprised of sections A, B, C and D, produced by needling staple fibers into a supporting web produces a local thickening of the web at the area where the fibers are needled-in. If a uniform fabric thickness is desired in the finished product, additional needling units may be provided with needle boards having a needle arrangement which effect additional inclusion of fibers in regions outside of those regions where the ornamental pattern is produced. For example, referring to FIG. 2, the ornamental pattern comprising the sections A, B, C and D may be supplemented by additional needling operation whereby the fiber of a contrasting color is applied in the areas surrounding each of the ornamental sections. Such additionl needling operations do not serve directly for producing a particular ornamental pattern but rather serve the purpose of filling in intervals between the patterns previously produced.

The aforementioned needling operations are subsequently followed by a conventional or usual needling operation to strengthen the nonwoven fabric by needling up, down or through the web. Such strengthening may be performed by means of known needling machines and this approach is of particular importance with regard to the production of three-dimensional, nonwoven pile fabrics, where a pile needling machine is used for the through-needling and the formation of the pile, respectively.

The needles which are utilized for the needle boards 6, 7 and 8 are of the type which will produce the desired pile layer forming the ornamental pattern of the fabric on the underside of the supporting web 3. That is, the loose fiber which is delivered upon the upper surface of the web 3 will actually be needled so as to form the desired visible pile layer upon the underside of the web 3. Thus, in terms of the finished fabric which is produced, the upper side will be the backside of the fabric and the underside will be the front or visible side. The needled fibers will protrude in loops or tufts from the underside in order to form thereon the pile of the fabric which will be arranged in the manner previously described, to form the desired ornamental pattern.

As a result of applying the loose fiber from the backside of the fabric, removal of loose fiber which has not been adequately needled into the web 3 is greatly facilitated. Since the dense pile will be formed on the underside, the suction duct 24 will operate much more effectively on the backside of the web to remove the loose fiber. Fiber removal will be faciliated to an even greater extent when the shearing or brushing rollers 23 are utilized in conjunction with the suction ducts 24.

As a result of the method of the invention, the ornamental pattern of the pile layer may be formed with greater accuracy. Loose fiber which has not been adequately needled into the supporting web 3 will be more thoroughly removed prior to movement of the web to a next succeeding needle board. Thus, each needle board will needle into the web only fiber which has been delivered upstream thereof, and not fiber intended for needling by a preceding needle board. The integrity of the pattern will be maintained and, particularly where differently colored fibers are to be needled-in by adjacent needle boards, undesired intermingling of colors will be avoided.

As previously discussed, the concepts of the present invention can be practiced by utilizing the various apparatus of the present invention together with known needling machines, for example, of the conventional type depicted in FIG. 1. However, the method according to the present invention may also be applied with other known needling machines. Such machines will require merely the addition of the feed ducts 19 and of the suction ducts 24 with the blowers 20, as well as the arrangment of the distributor rolls 22 and of the brushing rolls 23. However, the specific needling equipment may vary and may be conventional within the context of the present invention.

It will be seen that the method and apparatus of the present invention do not require means for printing ornaments upon a fabric or other additional machines for the production of the ornamental pattern. The pattern can, instead, be combined directly with the needling operations and the production of the patterns performed simultaneously with the needling operations. Only the needle boards will require equipment with needles corresponding to the ornamental patterns to be produced and care must be taken to insure that the intermittent feed of the supporting web is maintained with sufficient accuracy so that individual ornamental patterns which are to complement each other to form the overall pattern desired fit together exactly. Of course, it will be apparent that certain minor inaccuracies are not necessarily unacceptable since a pattern of rather soft coloration is obtained particularly since the underside of the supporting web becomes the visible surface. This is also true when additionl nonwoven fabric is applied and superimposed upon the needled fabric and is needled jointly therewith with the pattern fabric.

The nonwoven fabrics and fibers which may be utilized with the present invention include staple fibers of synthetic material which may, for example, be selected from the group consisting of polyamide, polyacrylic, polyester and polypropylene fibers.

While a specific embodiment of the invention has been shown and described in detail to illustrate the application of the inventive principles, it will be understood that the invention may be embodied otherwise without departing from such principles.

I claim:

1. A method for producing needle nonwoven pile fabric having a back side and a front side and consisting of a reinforced fabric web of backing material having needled thereinto loose staple fibers forming a visible pile layer on the front side of said fabric, said pile layer being composed of loose fibers of different types, said method comprising the steps of providing a needling machine for needling loose staple fibers into a backing web in an overall predetermined ornamental pattern, said needling machine including a plurality of needling stations each including needle means, said needle means of each one of said plurality of needling stations being arranged to needle loose fibers into said backing web in a pattern which consitutes one part only of said overall predetermined ornamental pattern, each of said plurality of needling stations being adapted to needle into said backing web one type of said different types of loose fibers, introducing said reinforced backing web into said needling machine with one side thereof facing upwardly and with the opposite side facing downwardly, intermittently passing the backing web through said needling stations in a given feed direction, delivering one type of said different types of loose staple fiber material upon said upwardly facing side of said web at a point upstream from each one of said plurality of needling stations, distributing said fiber material upon said web by operation of roller means extending across said web at a point upstream of each one of said plurality of needling stations to impart a predetermined thickness of fiber material upon said web, intermittently stopping said web with selected sections thereof located to be engaged by said needle means of each of said plurality of needling stations, operating said needle means of each of said plurality of needling stations to attach said fibers to said web at each of said plurality of needling stations in a pattern which forms a part of said overall predetermined ornamental pattern within the range of said selected sections of said web, said needle means operating to form said fibers as a visible pile on the downwardly facing side of said web to form said downwardly facing side as the front side of said fabric, with said upwardly facing side being formed as the back side of said fabric, and applying suction to the upwardly facing side of said web downstream of each one of said plurality of needling stations to withdraw from said web substantially all loose fibers of said one type delivered upstream of said one needling station and not attached to said web by said needle means of said one needling station, each of said needling stations having said needle means arranged thereat to apply said one type of fiber material delivered to each individual one of said plurality of needling stations in a pattern which constitutes one part only of said overall predetermined ornamental pattern to be produced, with intermittent passage of said web to all of said needling stations operating to provide the entire overall pattern upon said web, said suction means operating to insure that only said one type of loose fiber material delivered upstream of each one of said plurality of needling stations is needled into said web by said one needling station of said plurality of needling stations to avoid intermingling of one type of loose staple fiber material with another type of loose staple fiber material at an individual one of said plurality of needling stations.

2. The method according to claim 1 wherein fiber material of different colors is applied to said web and wherein a needling station is provided for each color to be applied with said fiber material being delivered in a desired color to each of said needling stations and with said suction being applied downstream of each of said needling stations for each color applied.

3. A method according to claim 1 wherein said selected sections of said web are subjected to a brushing operation downstream of each of said needling stations prior to application of said suction to loosen therefrom fibers not attached to said web by operation of said needle means and to expedite withdrawal of said loose fibers by application of said suction.

4. Apparatus for producing needled nonwoven pile fabric having a back side and a front side, and consisting of a fabric web of backing material having needled thereinto loose staple fiber material forming a visible pile layer on the front side of said fabric comprising a plurality of needling stations each including needle means for needling said loose staple fiber material into said backing web in a predetermined pattern, means for intermittently passing said backing web through said needling stations with one side thereof facing upwardly and with its opposite side facing downwardly and for stopping said web with selected sections thereof located to be engaged by said needle means, means for delivering said loose staple fiber material upon said upwardly facing side of said web at a point upstream from each of said needling stations, said needle means being located on the upper side of said web and operable to attach said fiber material to said web in said predetermined pattern within the range of said selected sections of said web with said fiber material forming a visible pile on the downwardly facing side of said web to form said downwardly facing side as the front side of said fabric, with said upwardly facing side being formed as the backside of said fabric, and suction means located on the upper side of said web downstream of each of said needling stations to withdraw from said upwardly facing side of said web loose fiber material not attached thereto by said needle means, each of said needling stations having said needle means arranged thereat to apply said fiber material in a pattern which constitutes one section only of an overall predetermined pattern to be produced, with intermittent passage of said web through all of said needling stations operating to provide the entire overall pattern upon said web, said suction means operating to insure that only loose fiber material delivered upstream of each one of said needling stations is needled into said web by said one needling station to avoid intermingling between fiber material delivered upstream of different needling stations.

5. Apparatus according to claim 4 wherein said delivering means include a plurality of feed ducts with one feed duct being located adjacent each of said needling stations and extending across said web transversely of said feed direction.

6. Apparatus according to claim 5 including roller means located relative to each of said feed ducts to distribute said delivered fiber material upon said web.

7. Apparatus according to claim 4 wherein said suction means comprise a plurality of suction ducts each including an inlet port, with each of said needling stations having a suction duct located downstream thereof, said inlet ports of each of said suction ducts being arranged to extend across said web transversely of said feed direction.

8. Apparatus according to claim 7 including a plurality of rotatably driven members each located to extend across said web transversely of said feed direction at each of said needling stations at a point between each said needling station and each of said suction duct inlet ports to mechanically loosen unattached fiber material from said upwardly facing side of said web to promote drawing off of said fiber material by said suction ducts.

9. Apparatus according to claim 8 wherein each of said rotatably driven members comprises a brush.

10. Apparatus according to claim 4 including means for recycling loose fiber material drawn off by said suction means downstream of any one of said needling back into the delivering means of the same needling stations.

* * * * *